US012502589B2

(12) United States Patent
Shneyer et al.

(10) Patent No.: US 12,502,589 B2
(45) Date of Patent: Dec. 23, 2025

(54) SNOW SPORT TRAINING HARNESS SYSTEM FOR CHILDREN

(71) Applicant: SLEEKE CORP., Brooklyn, NY (US)

(72) Inventors: Sam Shneyer, Brooklyn, NY (US); Eugene Sosnovsky, Brooklyn, NY (US)

(73) Assignee: SLEEKE CORP., Austin, TX (US)

( * ) Notice: Subject to any disclaimer, the term of this patent is extended or adjusted under 35 U.S.C. 154(b) by 996 days.

(21) Appl. No.: 17/592,221

(22) Filed: Feb. 3, 2022

(65) Prior Publication Data

US 2023/0241476 A1 Aug. 3, 2023

Related U.S. Application Data

(63) Continuation-in-part of application No. 29/825,550, filed on Feb. 2, 2022, now Pat. No. Des. 1,071,340.

(51) Int. Cl.
*A63B 69/00* (2006.01)
*A63B 69/18* (2006.01)

(52) U.S. Cl.
CPC ..... *A63B 69/0064* (2013.01); *A63B 69/0093* (2013.01); *A63B 69/18* (2013.01); *A63B 2208/12* (2013.01); *A63B 2225/09* (2013.01)

(58) Field of Classification Search
CPC . A63B 69/0064; A63B 69/0093; A63B 69/18; A63B 2244/19
USPC ..... 434/253
See application file for complete search history.

(56) References Cited

U.S. PATENT DOCUMENTS 1,193,374 A * 8/1916 Gilliam ..... A61H 3/008 482/69
4,424,040 A * 1/1984 Buchheister ..... A63B 69/18 119/770
4,505,681 A * 3/1985 Jones ..... A63C 11/10 273/DIG. 19
4,509,921 A * 4/1985 Buchheister ..... A63B 69/18 434/253
4,922,860 A 5/1990 Hutchings
5,074,795 A * 12/1991 Clark ..... A47D 13/086 119/857
5,080,191 A * 1/1992 Sanchez ..... A47D 13/086 280/801.1
5,564,729 A 10/1996 Gomez et al.
6,338,699 B1 * 1/2002 Veitch ..... A47D 13/086 119/770

(Continued)

*Primary Examiner* — Kurt Fernstrom
(74) *Attorney, Agent, or Firm* — Olav M. Underdal; IDP Patent Services

(57) ABSTRACT

A training harness system for snow sport training includes: a training harness that is wearable by a student, including: a harness body with a central leash receiving structure and left and right leash connector assemblies, each including at least one leash receiving structure with an elongated aperture; and a leash assembly, including first and second leashes, each including: an elongated leash member; a leash handle; and a leash connector with a hook portion, that includes an elongated hook member, such that the elongated hook member detachably connects with the at least one leash receiving structure; such that the training harness system enables a trainer to control and guide skiing or snowboarding of a student. The training harness system is configurable for beginner, intermediate, and advanced students, with different connections of the right and left leashes to the training harness.

14 Claims, 15 Drawing Sheets

(56) References Cited

U.S. PATENT DOCUMENTS

| | | | | |
|---|---|---|---|---|
| 6,361,478 | B1 * | 3/2002 | Giancaspro | A47D 13/086 482/69 |
| 8,147,252 | B1 * | 4/2012 | Stanford | A47D 13/046 434/255 |
| 9,446,295 | B2 | 9/2016 | Matte | |
| 9,950,233 | B2 * | 4/2018 | Bilbao | A63C 11/10 |
| 10,640,078 | B1 * | 5/2020 | Siegel | B60R 22/105 |
| 2014/0335492 | A1 * | 11/2014 | Braaten | A63B 69/18 434/253 |
| 2015/0031007 | A1 * | 1/2015 | Ruiz | A63B 69/18 434/253 |
| 2015/0099251 | A1 | 4/2015 | Anderson | |
| 2015/0258405 | A1 | 9/2015 | McCune et al. | |

* cited by examiner

Harness System for Snow Sport Training

Training Harness

SNOW SPORT TRAINING HARNESS SYSTEM FOR CHILDREN

CROSS-REFERENCE TO RELATED APPLICATIONS

This application is a Continuation-In-Part of U.S. Design Application No. 29/825,550, filed Feb. 2, 2022; which is hereby incorporated herein by reference in its entirety.

FIELD OF THE INVENTION

The present invention relates generally to the field of ski and snowboarding accessories, and more particularly to methods and systems for a training harness for children, for use during skiing and snowboarding.

BACKGROUND OF THE INVENTION

As skiing and snowboarding has become more and more popular, parents are increasing interested in opportunities for having their children learn how ski and snowboard.

Training harnesses have therefore become available in the marketplace to offer parents and professional trainers to control the downward descent on a snow sport slope. However, these existing harnesses are limited in their options for leash attachability and particularly do not offer variable leash attachment options for different skill levels combined with length adjustability, which thereby make them difficult to adjust for child students of different size and age. Furthermore, they have only few conventional options for attachment of skiing accessories.

As such, considering the foregoing, it may be appreciated that there continues to be a need for novel and improved devices and methods for training harnesses for children, for use during skiing and snowboarding.

SUMMARY OF THE INVENTION

The foregoing needs are met, to a great extent, by the present invention, wherein in aspects of this invention, enhancements are provided to the existing model of training harnesses for children, for use during skiing and snowboarding.

In an aspect, as a training harness system for snow sport training can include:

a) a training harness, which is configured to be mounted on and worn by a juvenile student, for example for practicing skiing or snowboarding; and b) a leash assembly, which can include:

i. at least one leash, which can be connected in a first end to the training harness, such that an adult trainer can hold on to a handle in a second of the at least one leash;

such that the training harness system enables the adult trainer to control and guide the skiing or snowboarding of a juvenile student.

In a related aspect, the leash assembly can include:

a) a first leash, which is configured to connect to a first side of a rear of the training harness; and b) a second leash, which is configured to connect to a second side of the rear of the training harness.

In a related aspect, the training harness can further include a leash mounting assembly, which can further include:

a) a left leash receiving assembly, which is configured to allow detachable connection of an inner end of a first/left leash;

b) a right leash receiving assembly, which is configured to allow detachable connection of an inner end of a second/right leash; and c) a central leash receiving structure, which is configured to allow detachable connection of an inner end of the at least one leash.

In a related aspect, each of the left leash receiving assembly and the right leash receiving assembly can further include:

a) at least one leash receiving structure, which comprises an elongated aperture, which protrudes through a length of the at least one leash receiving structure.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
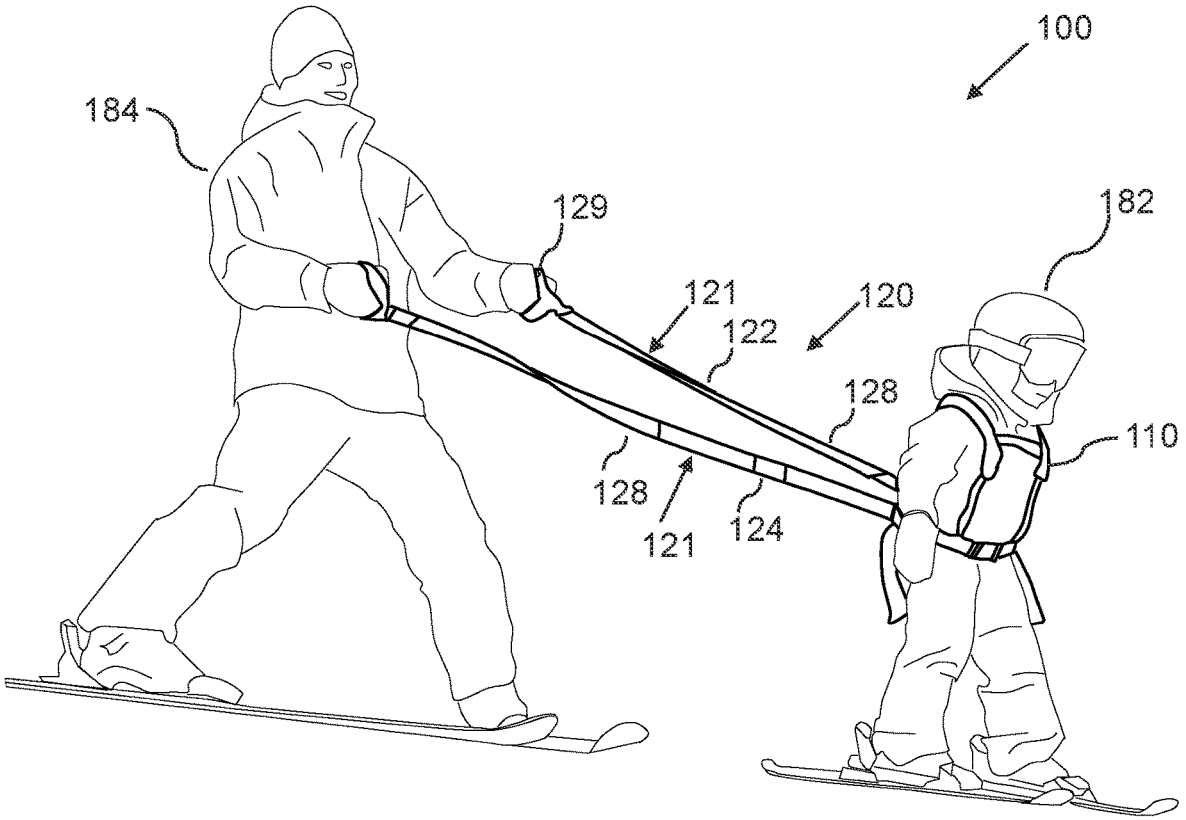
FIG. 1A is a perspective view of a training harness system for snow sport training, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a training harness system 100 with reference to FIG. 1A, in such manner that like reference numerals refer to like components throughout; a convention that we shall employ for the remainder of this specification.

In an embodiment, as shown in FIG. 1A, a training harness system 100 for snow sport training can include:

a) a training harness 110, which is configured to be mounted on and worn by a juvenile student 182, on a torso of the juvenile student 182, for example for practicing skiing (as shown in FIG. 1A) or snowboarding (as shown in FIGS. 4A-4D); and b) a leash assembly 120, which can include:

i. at least one leash 122, which can be connected to the training harness 110 in a first end at least one leash 122, such that an adult trainer 184 (such as a parent and/or trainer/coach) can hold on to a second end of the at least one leash 122 in a handle 129, which is positioned in a second end of the at least one leash 122;

such that the training harness system 100 enables the adult trainer 184 to control and guide the skiing or snowboarding of a juvenile student 182 when the training harness 110 is worn by the student 182. The training harness 110 can also be referred to as a harness device 110, a training harness device 110, a training vest 110, or a training harness vest 110.

Figure 1B:
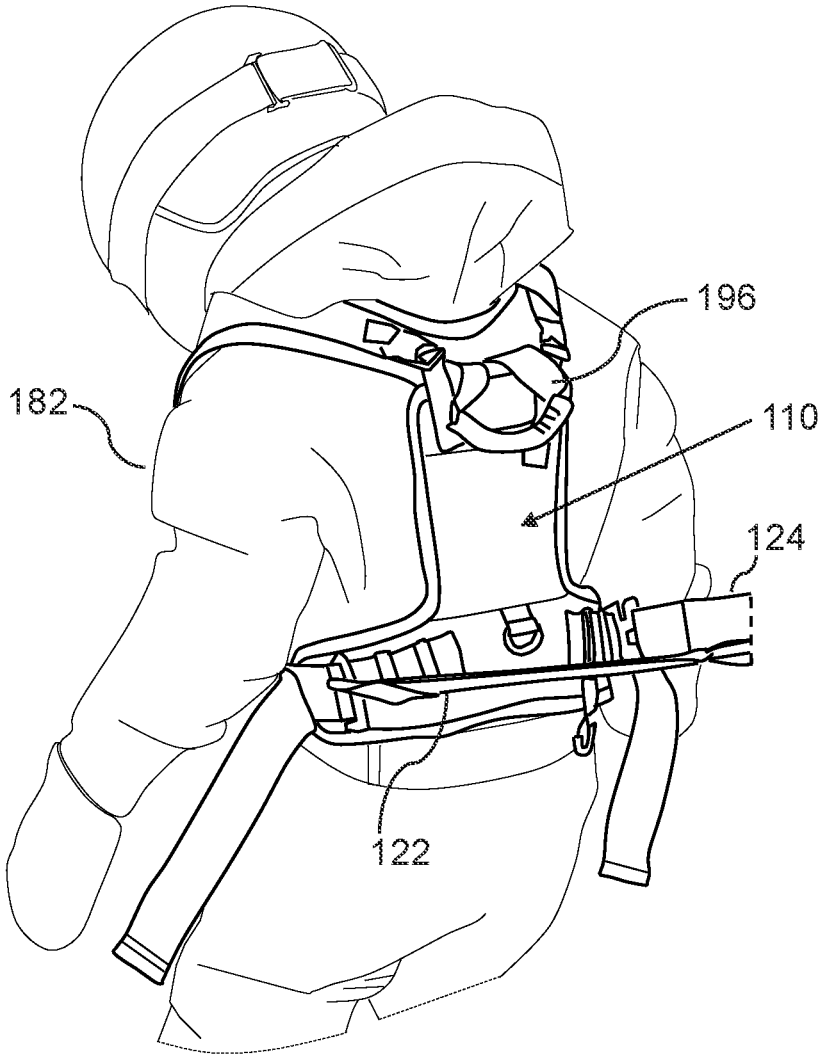
FIG. 1B is a perspective view of a portion of training harness system for snow sport training, according to an embodiment of the invention.
Figure 4A:
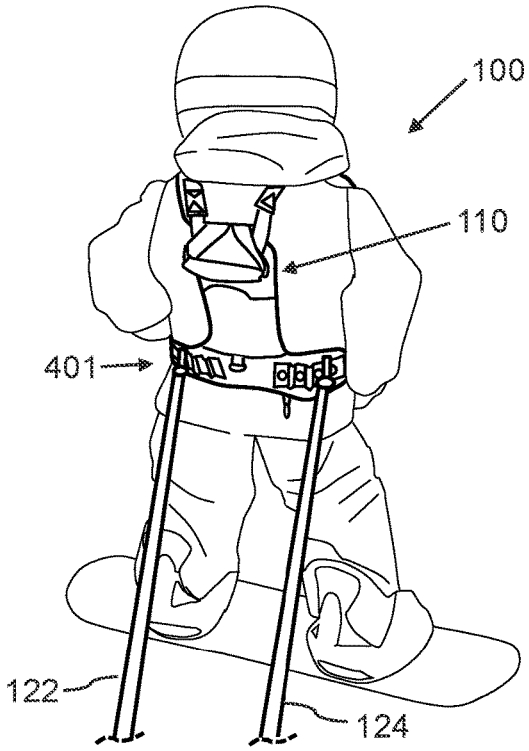
FIG. 4A is a rear side perspective view of a juvenile student using a training harness system in a first configuration for a beginner skill level, according to an embodiment of the invention.

In a related embodiment, as shown in FIGS. 1A and 1B the leash assembly 120 can include:

a) a first/left leash 121, 122, which is configured to connect to a first/left side of a rear of the training harness 110, as shown in FIGS. 1A, 1B, and 4A; and b) a second/right leash 121, 124, which is configured to connect to a second/right side of the rear of the training harness 110, as shown in FIGS. 1A, 1B, and 4A.

In a related embodiment, as shown in FIGS. 2A-2H and 3A-3B, the training harness 110 can include a harness body 210, which can include:

a) a back portion 220, which is configured to be positioned substantially on a back of a student 182 when the student 182 is wearing the training harness 110;

b) a shoulder portion 230, which is configured to be positioned on a shoulder area of the student 182 when the student 182 is wearing the training harness 110, wherein the shoulder portion 230 is above the back portion 220, wherein the shoulder portion further comprises:

i. a shoulder center portion 236;

ii. a right elongated shoulder member 234, such that an inner end of the right elongated shoulder member 234 is connected to a top right end of the center portion of the center portion 220;

iii. a left elongated shoulder member 232, such that an inner end of the left elongated shoulder member 232 is connected to a top left end shoulder center portion 236;

c) a folding portion 224, which is connected between the shoulder portion 230 and the back portion 220, wherein the harness body 210 can be configured to be length adjustable, such that a length 216 between the shoulder portion 230 and the back portion 220 is adjustable, such that the folding portion 224 is configured to adjust (i.e., adjust to length variation) accordingly. The folding portion 224 can be made of a relatively thin flexible material, such as a single layer of a nylon material;

d) a right hip member 244, which is configured to be positioned on a right hip area of the student 182 when the student 182 is wearing the training harness 110, such that an inner end of the right hip member 244 is connected to a bottom right end of the back portion 220; and e) a left hip member 242, which is configured to be positioned on a left hip area of the student 182 when the student 182 is wearing the training harness 110, such that an inner end of the left hip member 242 is connected to a bottom left end of the back portion 220.

Figure 2A:
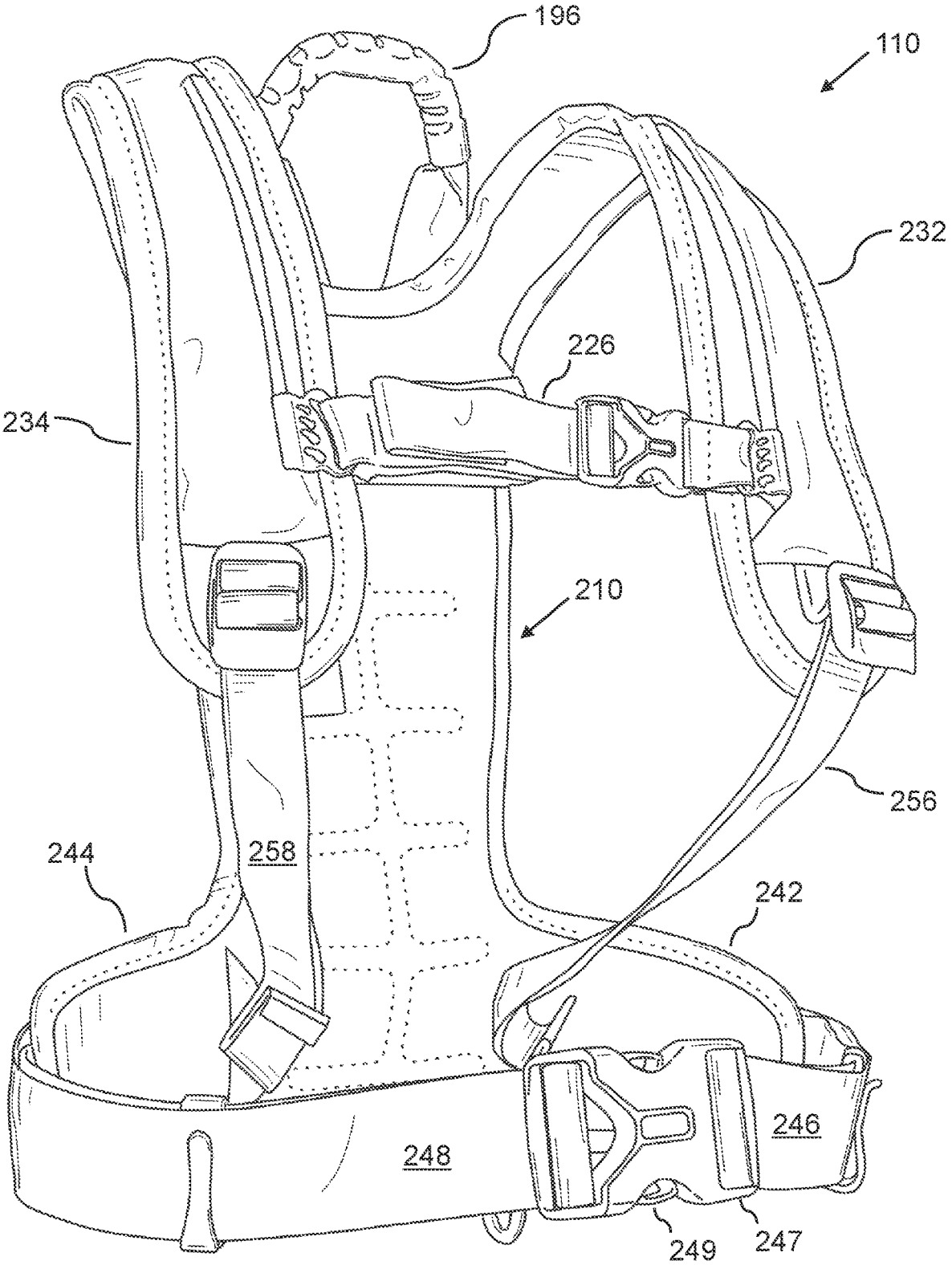
FIG. 2A is a front right perspective view of a training harness, according to an embodiment of the invention.
Figure 2B:
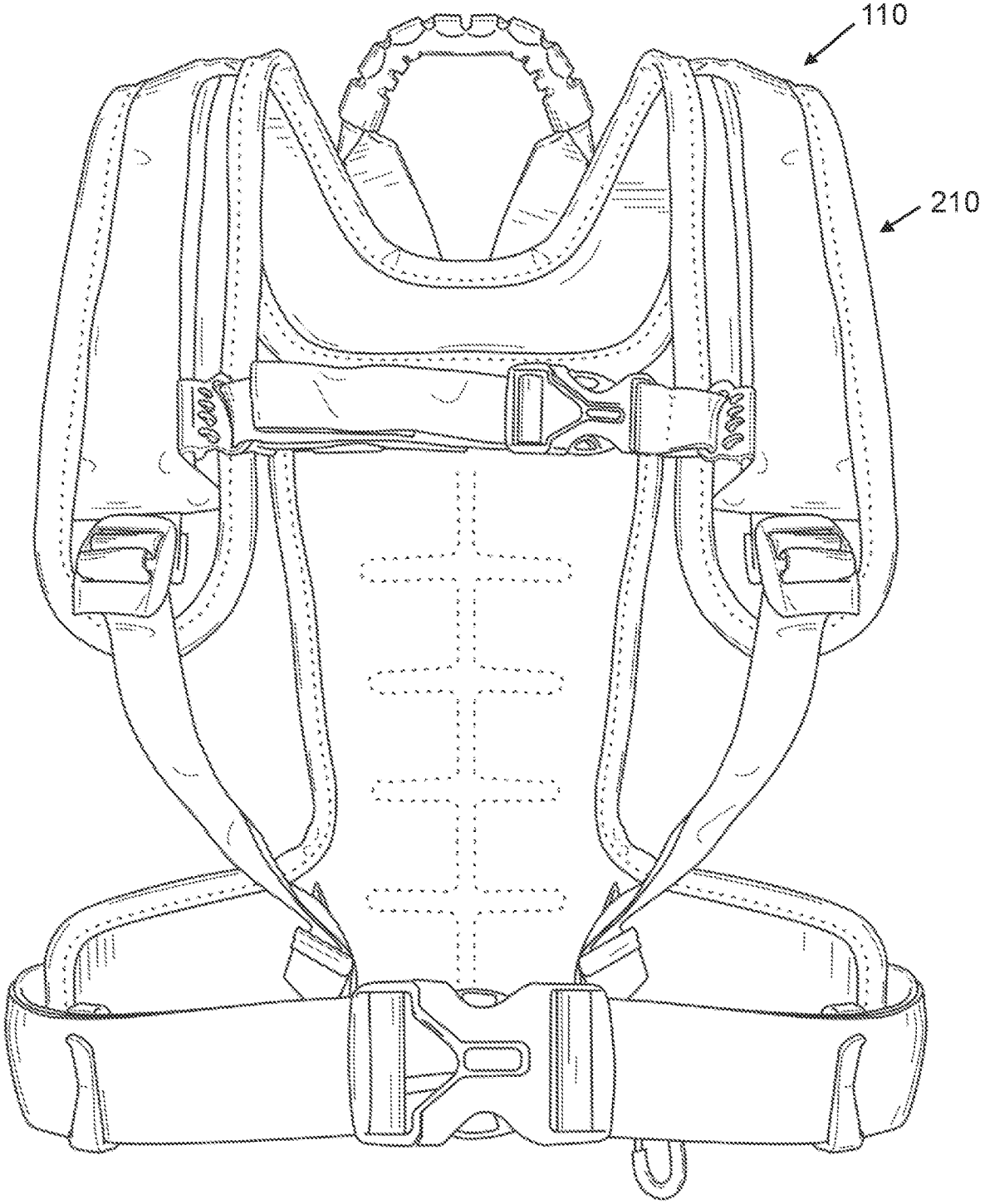
FIG. 2B is a front perspective view of a training harness, according to an embodiment of the invention.
Figure 2C:
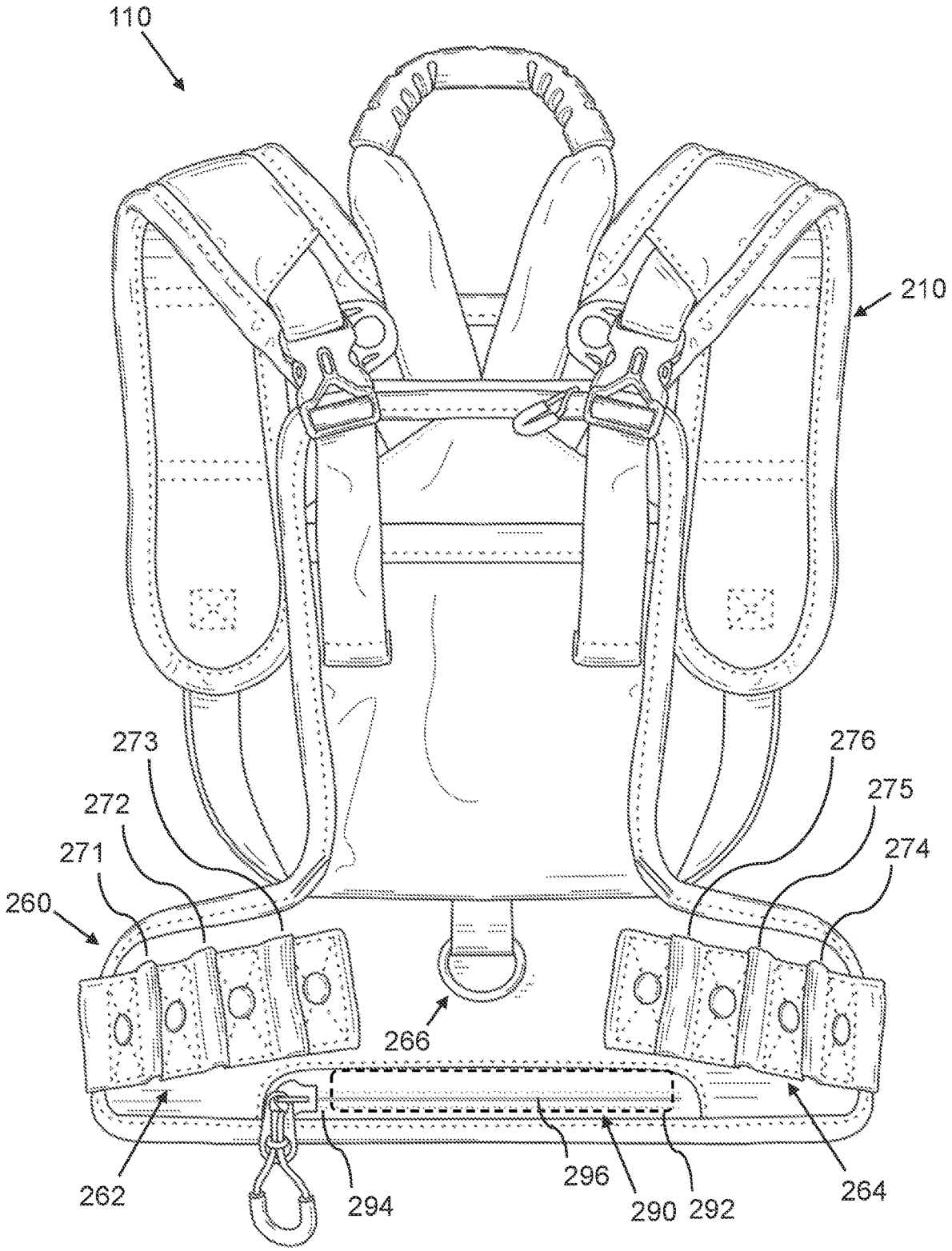
FIG. 2C is a rear perspective view of a training harness, according to an embodiment of the invention.
Figure 2D:
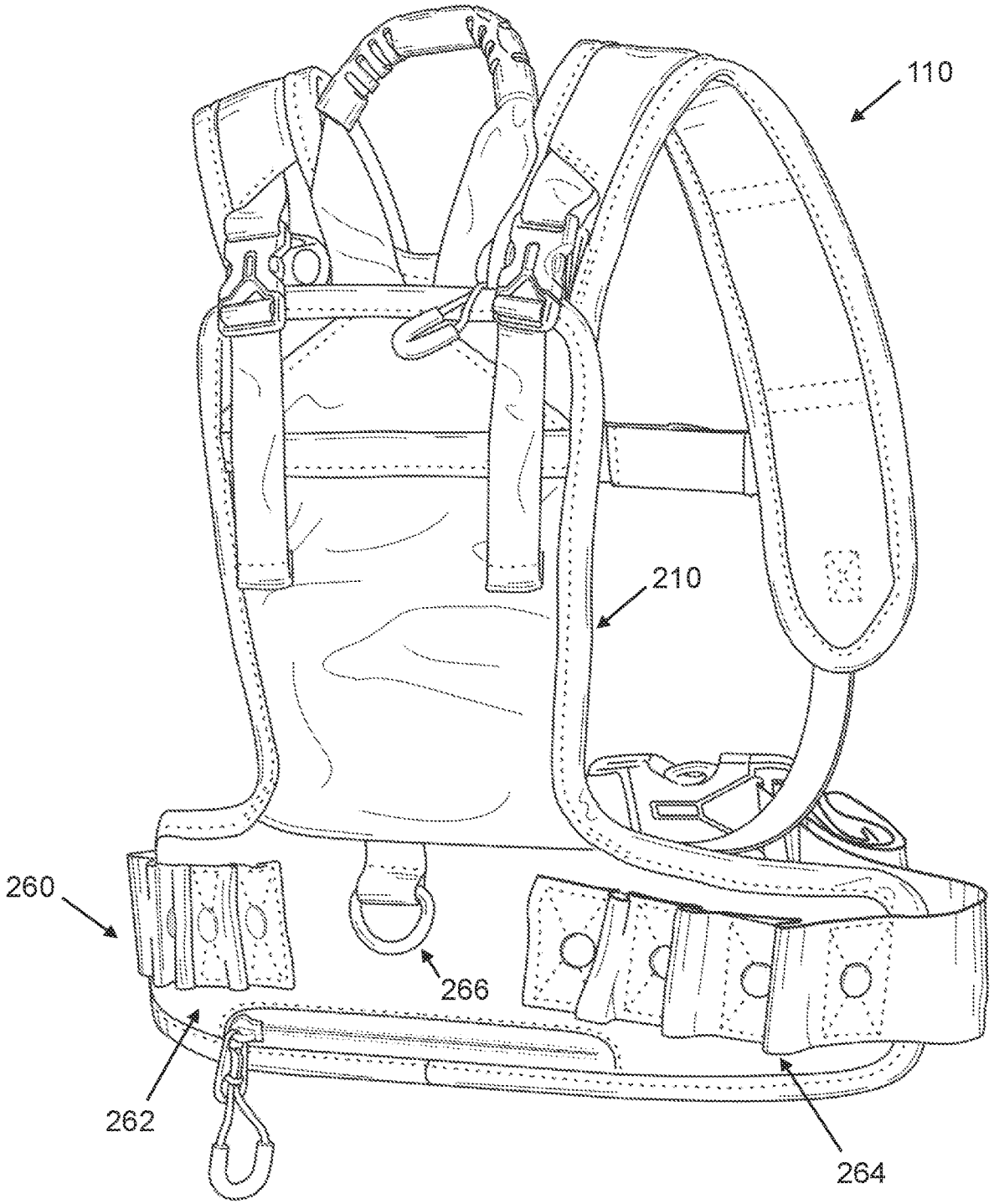
FIG. 2D is a rear right perspective view of a training harness, according to an embodiment of the invention.
Figure 2E:
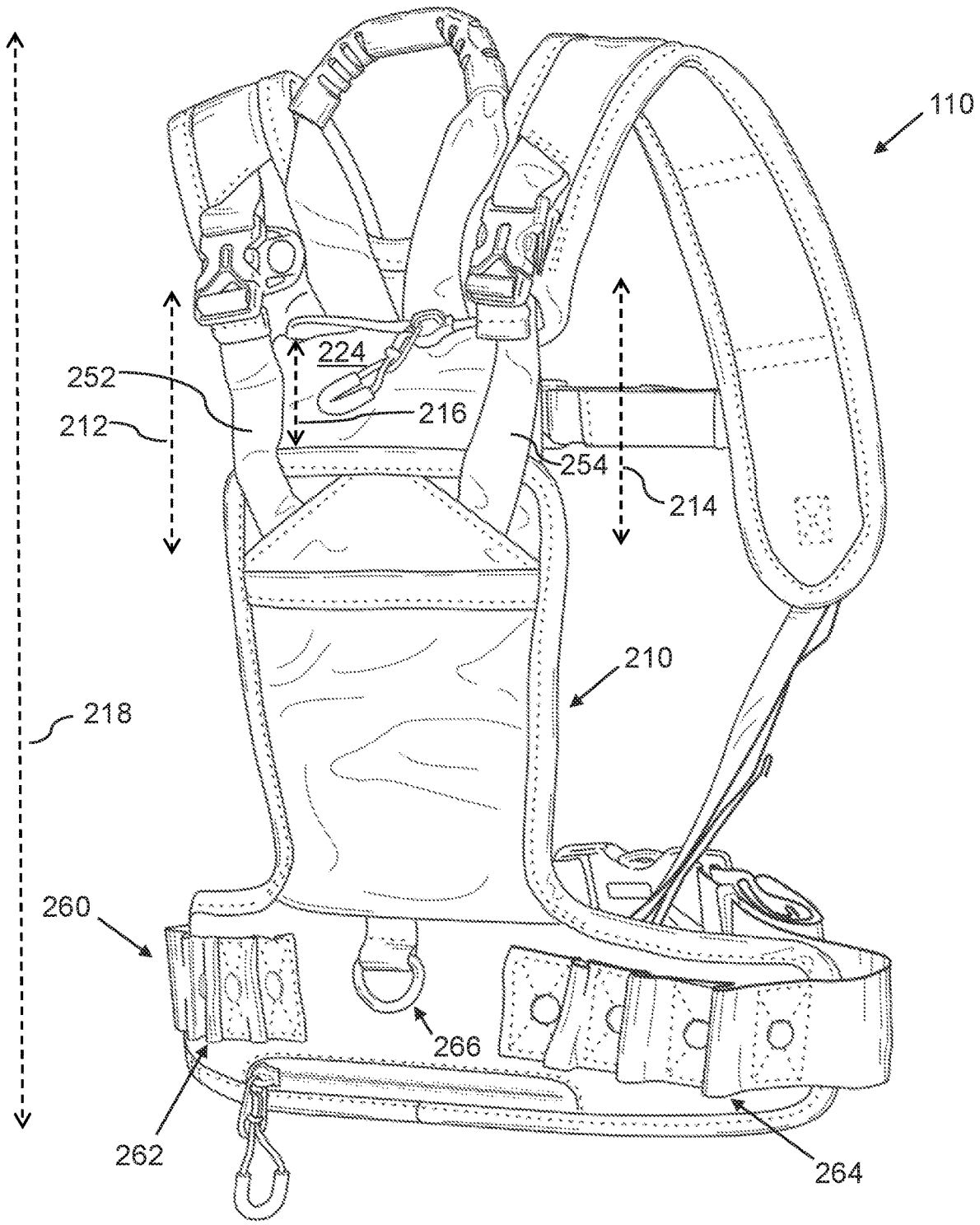
FIG. 2E is a rear right perspective view of a training harness, according to an embodiment of the invention.
Figure 2F:
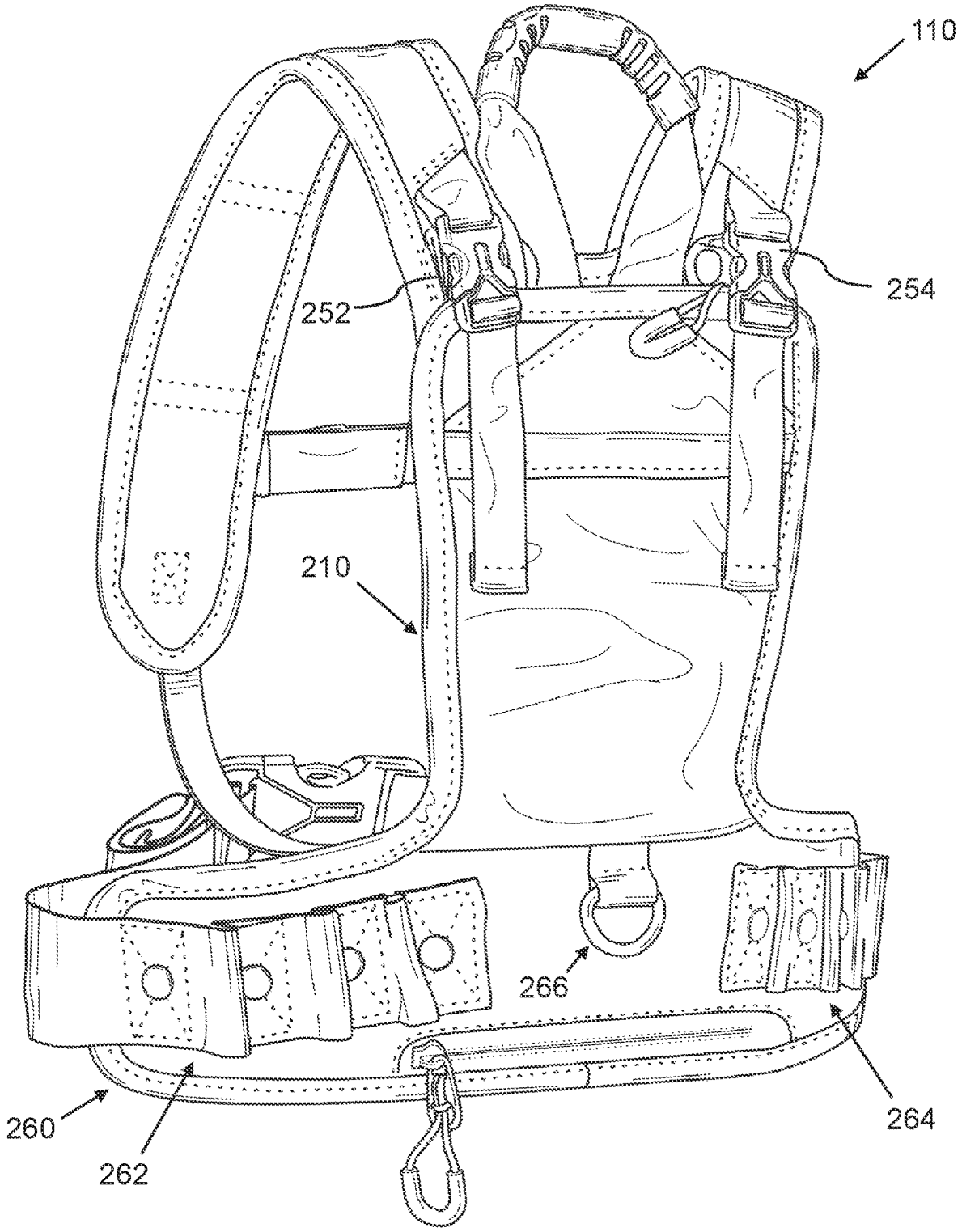
FIG. 2F is a rear left perspective view of a training harness, according to an embodiment of the invention.
Figure 2G:
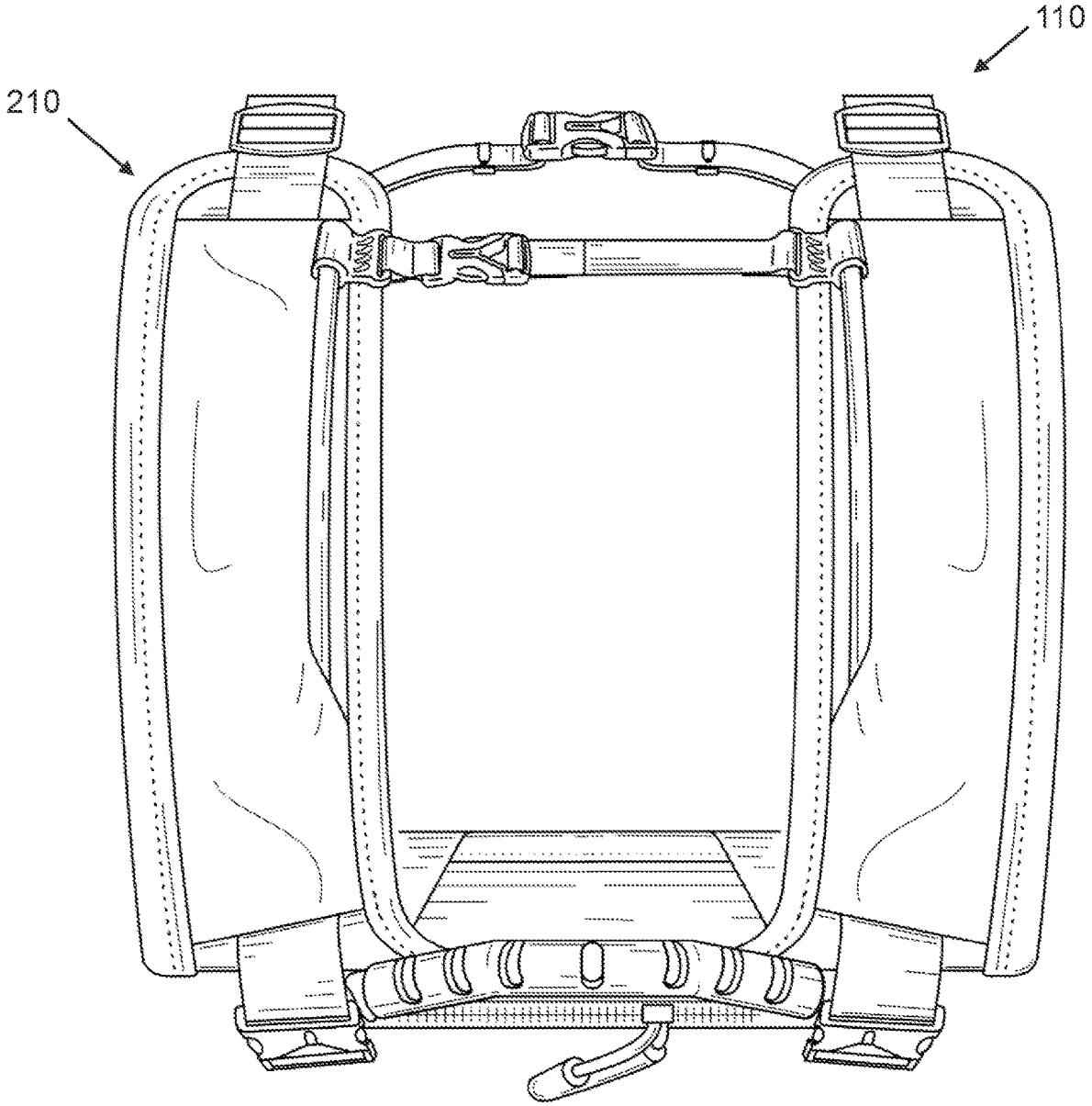
FIG. 2G is a top perspective view of a training harness, according to an embodiment of the invention.
Figure 2H:
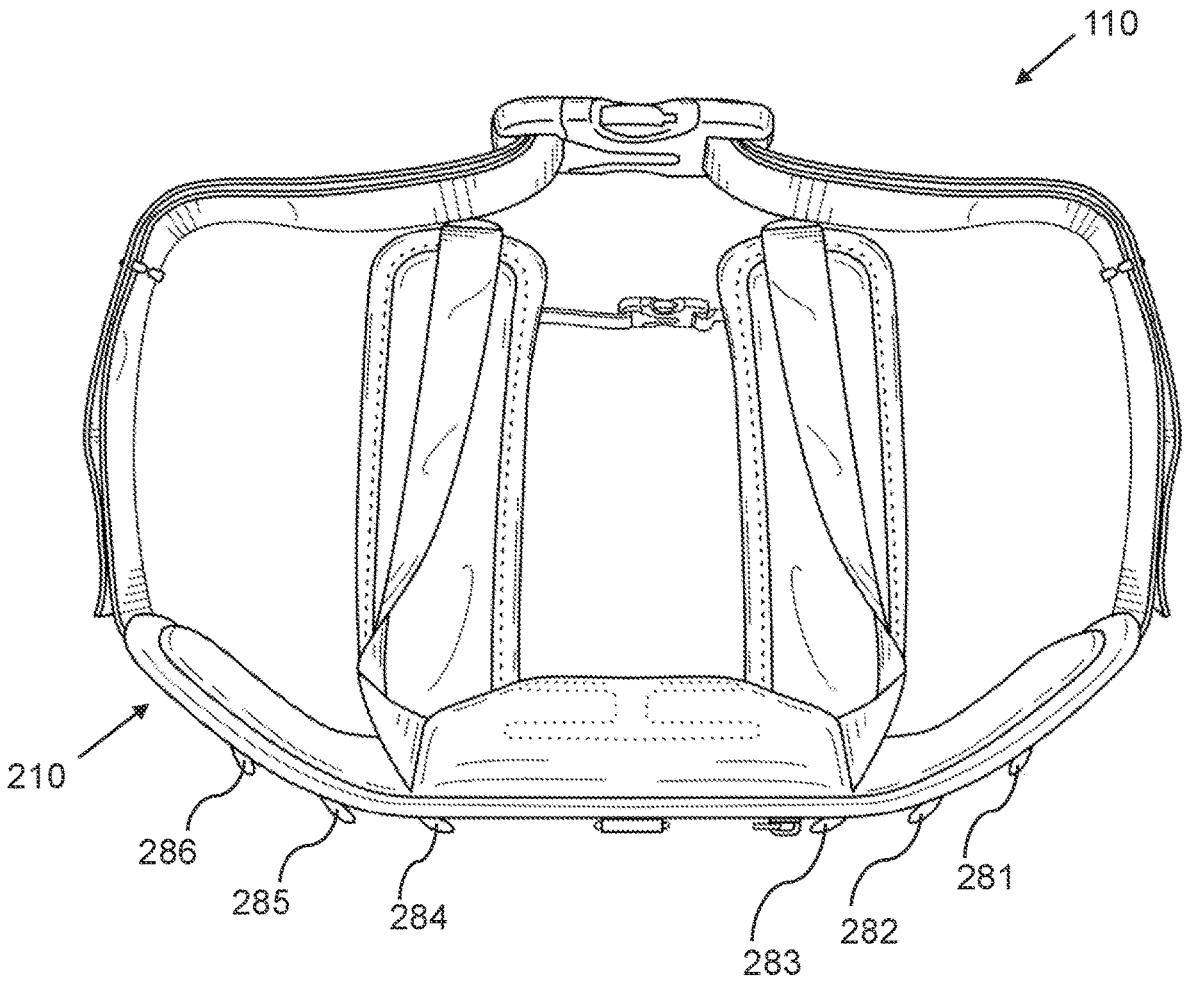
FIG. 2H is a bottom perspective view of a training harness, according to an embodiment of the invention.
Figure 3A:
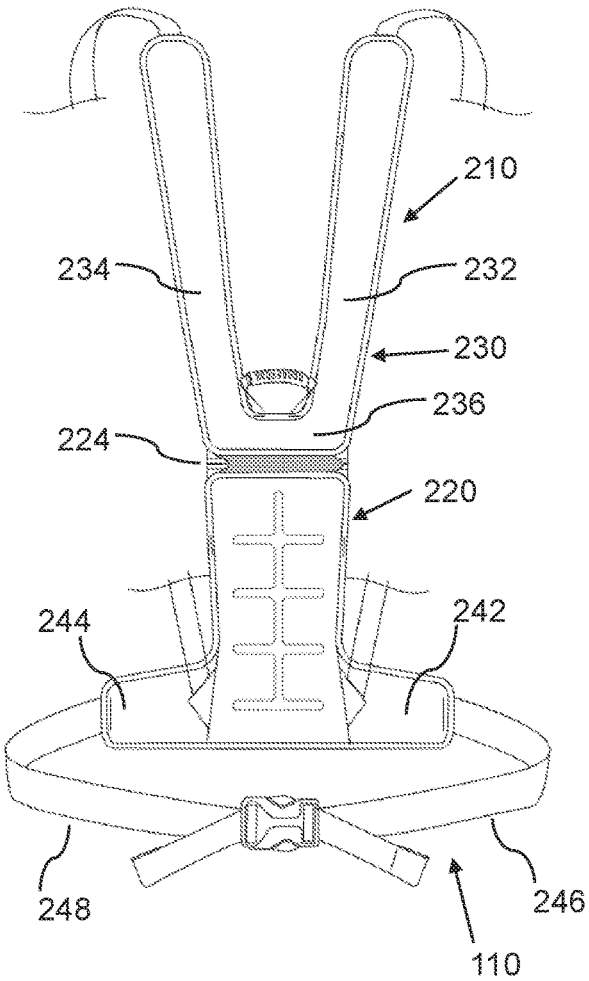
FIG. 3A is an outer side view of main portions of a training harness in a flat orientation, according to an embodiment of the invention.
Figure 3B:
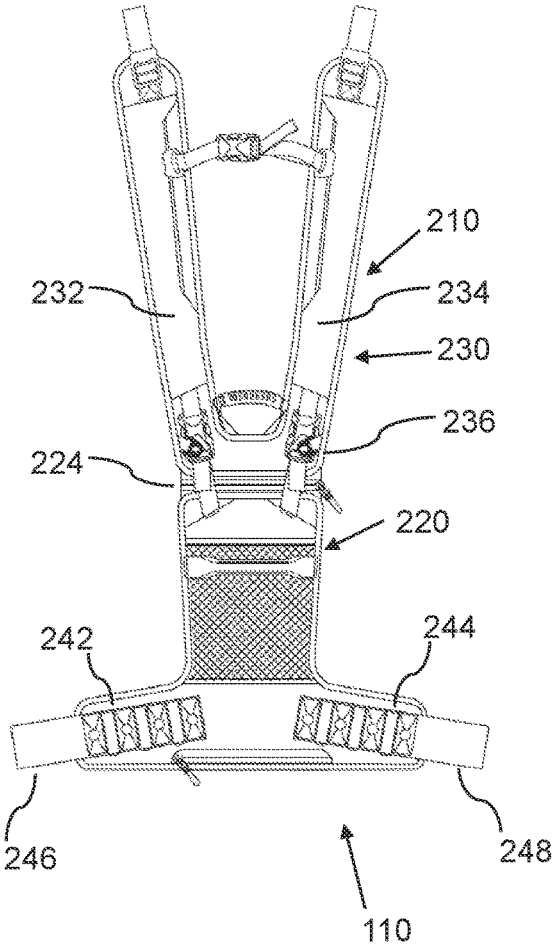
FIG. 3B is an inner side view of main portions of a training harness in a flat orientation, according to an embodiment of the invention.

In a related embodiment, the training harness 110 can include:

a) a left adjustable shoulder strap 252, which is connected between the shoulder portion 230 and the back portion 220; and b) a right adjustable shoulder strap 254, which is connected between the shoulder portion 230 and the back portion 220, such that the right adjustable shoulder strap 254 is mounted on a right side of the left adjustable shoulder strap 252; and such that adjustment of a first/left length 212 (shown in FIG. 2E of the left adjustable shoulder strap 252 and adjustment of a second/right length 214 (shown in FIG. 2E) of the left adjustable shoulder strap 252 causes an adjustment of a corresponding length/height 216 (shown in FIG. 2E) of the folding portion 224 of the harness body 210, wherein the folding portion 224 is configured to adjust (i.e. fold or stretch flat) according to the corresponding length 216;

whereby a total length/height 218 of the training harness 110 (from top of shoulder portion to bottom of hip members) can be adjusted to fit the juvenile student 182. FIG. 2E shows the training harness 110 in an expanded/maximal length configuration with a stretched out folding portion 224, and FIG. 2D shows the training harness 110 in a collapsed/minimum length configuration with a folded-up folding portion 224.

In a related embodiment, as shown in FIGS. 2C, 2D, 2E, and 2F, the training harness 110 can further include a leash mounting assembly 260, which can further include:

a) a left leash receiving assembly 262, which can be positioned on the left hip member 242, wherein the left leash receiving assembly 262 is configured to allow detachable connection of an inner end of a first/left leash 121, 122 (and alternatively of the right leash);

b) a right leash receiving assembly 264, which can be positioned on the left hip member 242, wherein the right leash receiving assembly 264 is configured to allow detachable connection of an inner end of a second/right leash 121, 124 (and alternatively of the left leash); and c) a central leash receiving structure 266, which can be ring-shaped, wherein the central leash receiving structure 266 can be positioned in a central position of a bottom portion of the harness body 210, substantially between the left leash receiving assembly 262 and the right leash receiving assembly 264;

wherein the central leash receiving structure 266 is configured to allow detachable connection of an inner end of the at least one leash 121, such as an inner end of each of a left leash 121, 122 and/or a second/right leash 121, 124 (either separately or simultaneously).

In a related embodiment, as shown in FIGS. 2C, 2D, 2E, and 2F, each of the left leash receiving assembly 262 and the right leash receiving assembly 264 can further include:

a) a plurality of leash receiving structures 271, 272, 273, 274, 275, 276, or at least one leash receiving structure 271, 272, 273, 274, 275, 276, which comprises (or each comprise) an elongated aperture 281, 282, 283, 284, 285, 286, which protrudes through a length of the at least one leash receiving structure 271, 272, 273, 274, 275, 276, such that the plurality of leash receiving structures 271, 272, 273, 274, 275, 276 can provide different leash attachment options on right and left sides of a hip of the juvenile student 182, to adjust for size and comfort of the juvenile student 182;

In a further related embodiment, as shown in FIGS. 2A, 2C, 2D, 2E, and 2F, each of the left leash receiving assembly 262 and the right leash receiving assembly 264 can be made from a single strap of a fabric material (such as a ballistic nylon material), such that the plurality of leash receiving structures 271, 272, 273, 274, 275, 276 are formed as folds (which can also be referred to as webbing loops 271, 272, 273, 274, 275, 276) of the strap, and wherein each single strap can further form respectively left and right belt straps 246, 248.

In related embodiments, the plurality of leash receiving structures 271, 272, 273, 274, 275, 276 and the central leash receiving structure 266 provides multiple hip connection points for the at least one leash 120, which can provide adjustability, to ensure proper isolation and control of the juvenile student's 182 hip during skiing or snowboarding, whereas with only one connection point or dual fixed connection points, depending on size of the juvenile student's 182, the at least one leash 120 would only pull the juvenile student's 182 back, and not be able to provide effective hip turning control.

Furthermore, in related embodiments, the combination of:

a) length/height adjustability of the harness body 210, via the folding portion 224 and the left and right adjustable shoulder straps 252, 254; and b) the multiple connection points for the at least one leash 120, via the plurality of leash receiving structures 271, 272, 273, 274, 275, 276 and the central leash receiving structure 266;

allow for an optimized fit for all sizes of juvenile student's 182, herein particularly for juvenile student's 182 in the age range 2-7.

Figure 5A:
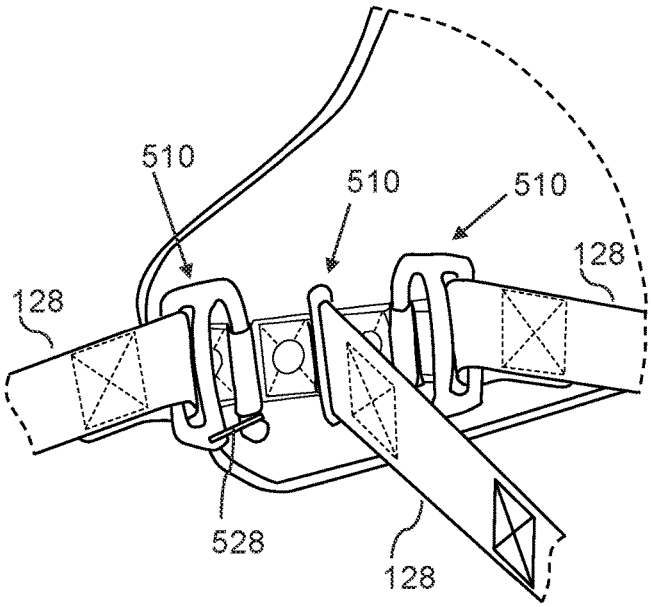
FIG. 5A is a perspective view of a right leash attachment portion of a training harness of the training harness system showing different leash attachment positions, according to an embodiment of the invention.
Figure 6A:
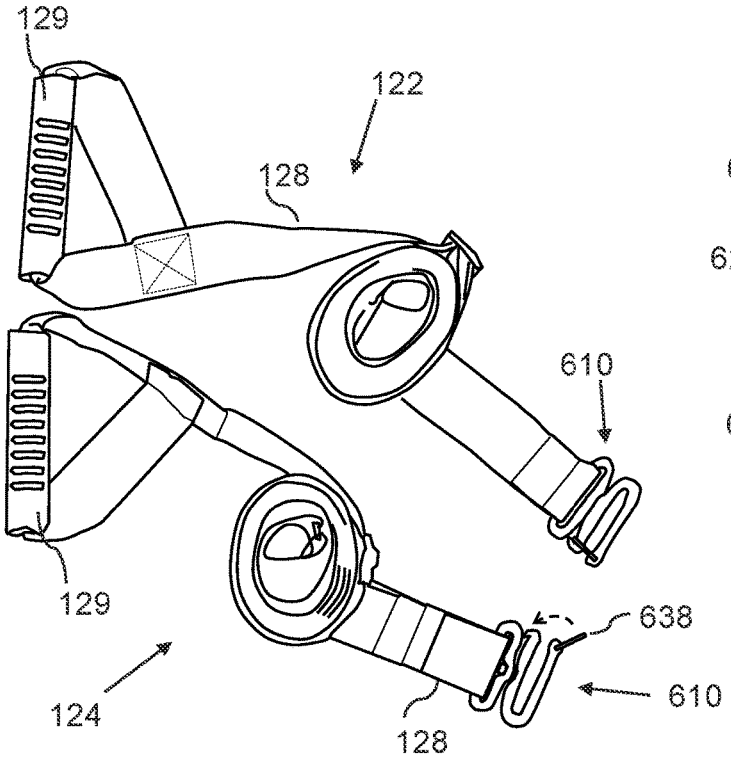
FIG. 6A is a perspective view of a right leash and a left leash of the training harness system, according to an embodiment of the invention.

In a related embodiment, as shown in FIGS. 1A, 5A, and 6A, each of the first leash 121, 122 and the second leash 121, 124 can include:

a) an elongated leash member 128, which can be an elongated strip, which can be made of an elastic material, such as an elastic fabric, rubber or composite, such that the elongated leash member 128 is flexible, elastic, and shock absorbing; and wherein the leash member 128 can be configured (with clasps) to be length adjustable;

b) a leash handle 129, which is connected to an outer end of the leash member 128; and c) a leash connector 510, 610, which can include:

i. a circular portion 520, 620, comprising a central aperture 522, 622 wherein the circular portion 520, 620 is configured to attach to an inner end of the leash member 128, such that the inner end of the leash member 128 protrudes through the central aperture 522, 622 of the circular portion 520, 620; and ii. a hook portion 530, which can include an elongated hook member 534, such that the hook portion 530 is connected to an outer upper side of the circular portion 520, such that a lower opening 526 is formed between the circular portion 520 and the elongated hook member 534 to allow insertion of the elongated hook member 534 into the elongated aperture 281, 282, 283, 284, 285, 286 of the at least one leash receiving structure 271, 272, 273, 274, 275, 276;

such that the elongated hook member 534 is configured to detachably connect with (i.e., hook onto) the at least one leash receiving structure 271, 272, 273, 274, 275, 276, such that the elongated hook member 534 is inserted into the elongated aperture 281, 282, 283, 284, 285, 286.

In a further related embodiment, the elongated leash member 128 can be length adjustable and can include preset distance markers, which can be measured at 1' foot increments, such that a length of the elongated leash member 128 can be adjusted according to an experience level of the juvenile student 182.

Figure 5B:
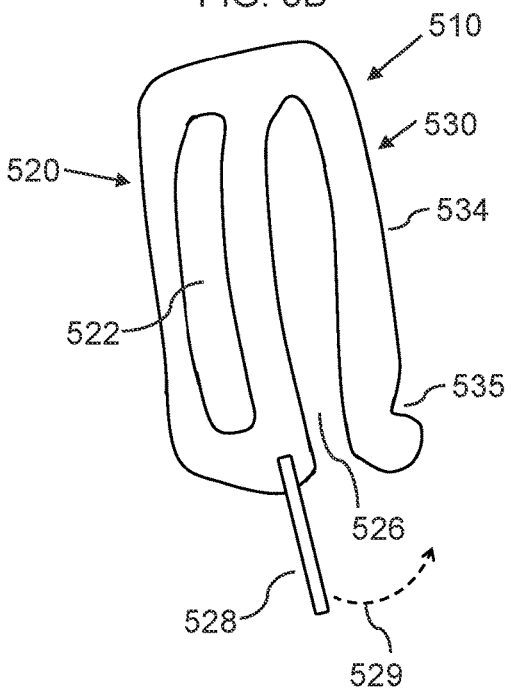
FIG. 5B is a perspective view of a leash receiving assembly of the training harness system with a stationary hook portion, according to an embodiment of the invention.
Figure 5C:
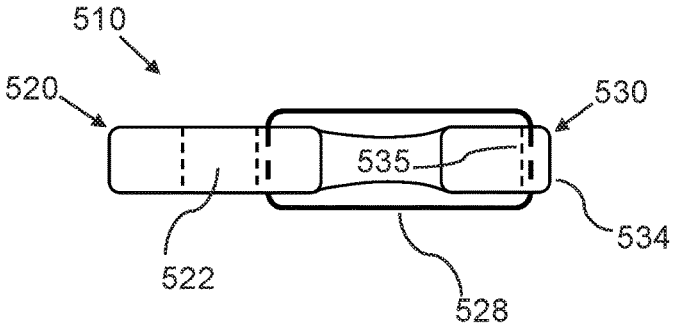
FIG. 5C is a bottom view of a leash receiving assembly of the training harness system with a stationary hook portion, according to an embodiment of the invention.
Figure 6B:
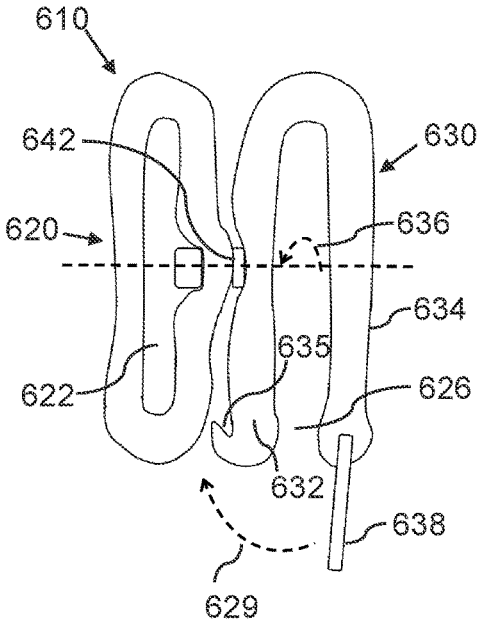
FIG. 6B is a perspective view of a leash receiving assembly of the training harness system with a rotatable hook portion, according to an embodiment of the invention.
Figure 6C:
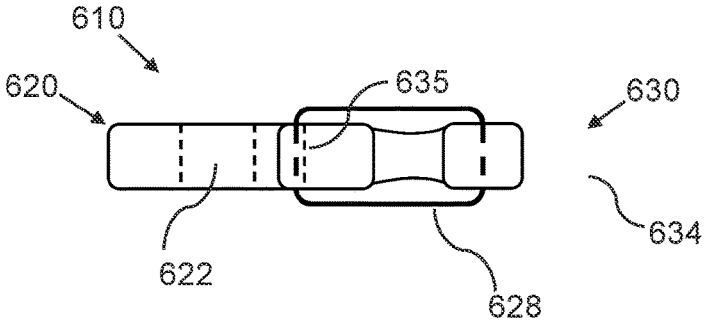
FIG. 6C is a bottom view of a leash receiving assembly of the training harness system with a rotatable hook portion, according to an embodiment of the invention.

In a further related embodiment, as shown in FIGS. 6A and 6B, the hook portion 630 can be configured with an inverted u-shape (i.e., a u-shape with opening pointed downward when mounted on the leash receiving structure), such that the hook portion 630 can include:

a) an inner portion 632, which is connected to the circular portion; and b) the elongated hook member 534, 634, which is connected to an upper end of the inner portion 632 on an outer upper side of the inner portion 632, such that a lower opening 626 is formed between the inner portion 632 and the elongated hook member 634 to allow insertion of the elongated hook member 634 into the elongated aperture 281, 282, 283, 284, 285, 286 of the at least one leash receiving structure 271, 272, 273, 274, 275, 276;

In a further related embodiment, as shown in FIGS. 5A-5C and 6A-6C, the leash connector 510, 610 can further include a clasp 528, 628, such that an inner end of the clasp 528 can be rotatably 529, 629 connected to a lower end of a first portion of a body of the leash connector 510, 610, such that an outer end of the clasp 528 can be clasped and closed in place on a lower end of a second portion of the body of the leash connector 510, 610, wherein the lower end of a second portion of the body can be configured with a notch 535, 635, which is configured to hold the clasp 528, 628 in place in the closed position, as shown in FIGS. 5A, 5C, and 6C, such that the elongated hook member 534, 634 is securely connected with the at least one leash receiving structure 271, 272, 273, 274, 275, 276. As shown in FIGS. 5C and 6C, the clasp 528, 628 can be loop-shaped such that it can clasp around the lower part of the elongated hook member 534.

In a yet further related embodiment, as shown in FIGS. 5A, 5B and 5C, the leash connector 510 can further include a clasp 528, such that an inner end of the clasp 528 can be rotatably 529 connected to a lower end of the circular portion 520, such that an outer end of the clasp 528 can be clasped and closed in place on a lower end of the elongated hook member 534, wherein the lower end of the elongated hook member 534 can be configured with a notch 535, which can be configured to hold the clasp 528 in place in the closed position, as shown in FIGS. 5A and 5C, such that the elongated hook member 534 is securely connectable with the at least one leash receiving structure 271, 272, 273, 274, 275, 276. As shown in FIG. 5C, the clasp 528 can be loop-shaped such that it can clasp around the lower part of the elongated hook member 534.

In a yet further related embodiment, as shown in FIGS. 6A, 6B and 6C, the leash connector 610 can further include a clasp 628, such that an inner end of the clasp 628 can be rotatably 629 connected to a lower end of the elongated hook member 634, such that an outer end of the clasp 528 can be clasped and closed in place on a lower end of the inner portion 632, wherein the lower end of the inner portion 632 can be configured with a notch 635 to hold the clasp 628 in place in the closed position, as shown in FIGS. 6A and 6C, such that the elongated hook member 634 is securely connected with the at least one leash receiving structure 271, 272, 273, 274, 275, 276. As shown in FIG. 6C, the clasp 528 can be loop-shaped, such that it can clasp around the lower part of the inner portion 632.

In a further related embodiment, as shown in FIG. 6B, the leash connector 610 can be configured with a rotatable hook portion 630, such that the hook portion 630 can be rotatably connected to the circular portion 620, such that the hook portion 630 can rotate 636 relative to the circular portion 520, to allow a rotatable connection of a leash 121, 122, 124 to the training harness 110. The hook portion 630 can be rotatably connected to the circular portion 620 via a center axle 642.

In a further related embodiment, the left leash receiving assembly 262 can further include:

a) a left outer leash receiving structure 271, which comprises a left outer elongated aperture 281, which protrudes through a length of the left outer leash receiving structure 271;

b) a left center leash receiving structure 272, which comprises a left center elongated aperture 282, which protrudes through a length of the left center leash receiving structure 272; and c) a left inner leash receiving structure 273, which comprises a left inner elongated aperture 283, which protrudes through a length of the left inner leash receiving structure 273;

such that the left outer leash receiving structure 271, the left center leash receiving structure 272, and the left inner leash receiving structure 273 can provide different leash attachment options on a left side of a hip of the juvenile student 182, to adjust for size and comfort of the juvenile student 182.

In a further related embodiment, the right leash receiving assembly 262 can further include:

a) a right outer leash receiving structure 274, which comprises a right outer elongated aperture 284, which protrudes through a length of the right outer leash receiving structure 274;

b) a right center leash receiving structure 275, which comprises a right center elongated aperture 285, which protrudes through a length of the right center leash receiving structure 275; and c) a right inner leash receiving structure 276, which comprises a right inner elongated aperture, which protrudes through a length of the right inner leash receiving structure 276;

such that the right outer leash receiving structure 274, the right center leash receiving structure 275, and the right inner leash receiving structure 276 can provide different leash attachment options on a right side of a hip of the juvenile student 182, to adjust for size and comfort of the juvenile student 182.

Figure 4B:
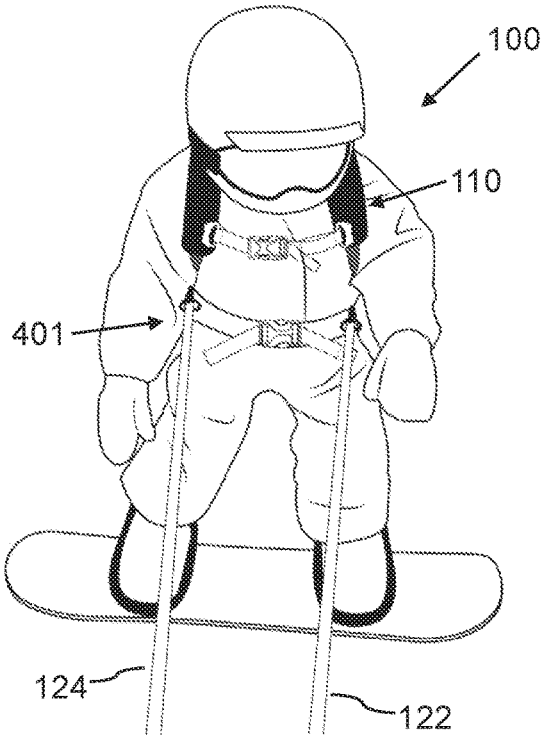
FIG. 4B is a front side perspective view of the juvenile student using the training harness system in the first configuration for the beginner skill level, according to an embodiment of the invention.
Figure 4C:
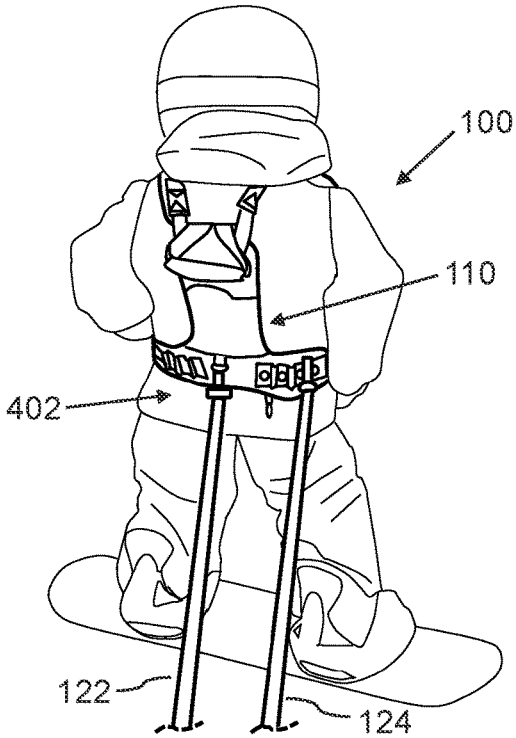
FIG. 4C is a rear side perspective view of the juvenile student using the training harness system in a second configuration for an intermediate skill level, according to an embodiment of the invention.
Figure 4D:
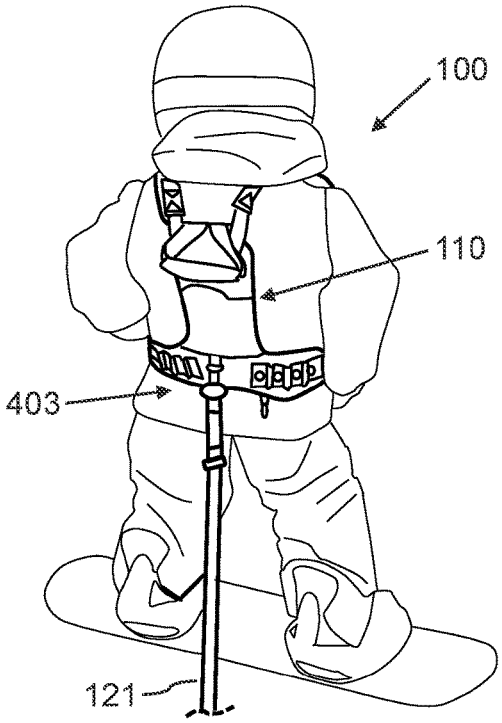
FIG. 4D is a rear side perspective view of the juvenile student using the training harness system in a third configuration for an advanced skill level, according to an embodiment of the invention.

In a related embodiment, as shown in FIGS. 4A-4D, the training harness system 100 can be configured in:

a) a beginner configuration 401, which can also be referred to as a first configuration 401, as shown in FIGS. 4A and 4B, which is suitable for a beginner skill level of the juvenile student 182:

i. Attach the left and right leash connectors to each side of the hip and select an optimum position. For beginners, both cords need to be attached on each side of the student's hips;

wherein the training harness system is configured in a beginner configuration, such that the inner end of the left leash is connected to the left outer leash receiving structure and the inner end of the right leash is connected to the right outer leash receiving structure;

b) an intermediate configuration 402, which can also be referred to as a second configuration 402, as shown in FIG. 4C, which is suitable for an intermediate skill level of the juvenile student 182:

i. hook one bungee cord/clip to the center steel ring and one on the waist side connection and you'll be able to control the speed of your student when practicing going straight downhill. This setting is best to practice linking turns;

wherein the training harness system is configured in an intermediate configuration, such that the inner end of the left leash is connected to the central leash receiving structure and the inner end of the right leash is connected to the right outer leash receiving structure; and c) an advanced configuration 403, which can also be referred to as a third configuration 403, as shown in FIG. 4D, which is suitable for an advanced skill level of the juvenile student 182:

i. Attach both or just one bungee clip to the center ring only. This position is preferred to control speed for the advanced student and works best when the child has progressed and started linking turns. This connection gives the child more freedom but still gives instructor full speed control;

wherein the training harness system is configured in an advanced configuration, such that an inner end of the at least one leash is connected to the central leash receiving structure.

In another related embodiment, as shown in FIGS. 1B and 2A, the training harness system 100 can further include:

a) a lifting handle 196, which can be connected to a top portion of the harness body 210;

such that lifting handle 196 is configured to enable a trainer 184 to help lift a student 182 from the ground, when the student is wearing the training harness system 100.

Figure 7A:
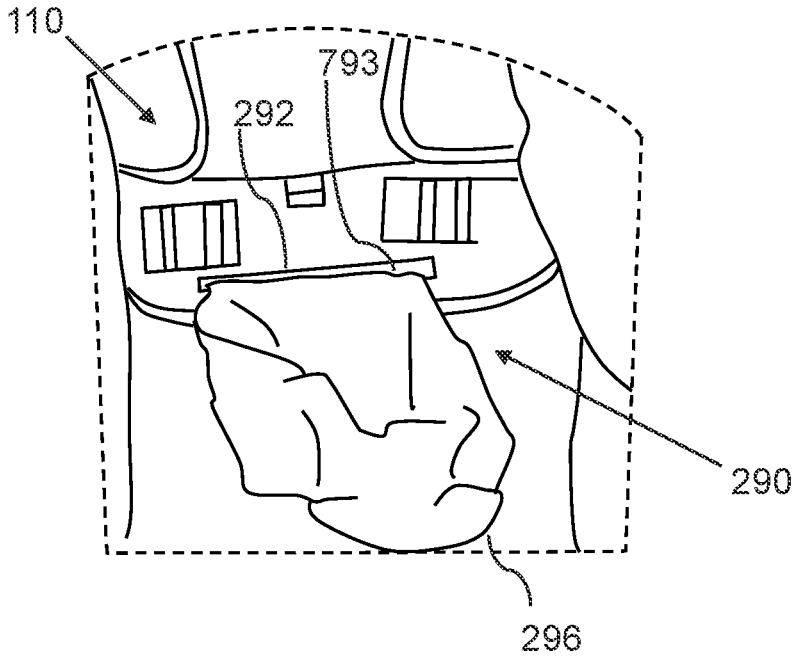
FIG. 7A is a rear perspective view of an unfolded helmet holding flexible bag of a training harness of the training harness system, according to an embodiment of the invention.
Figure 7B:
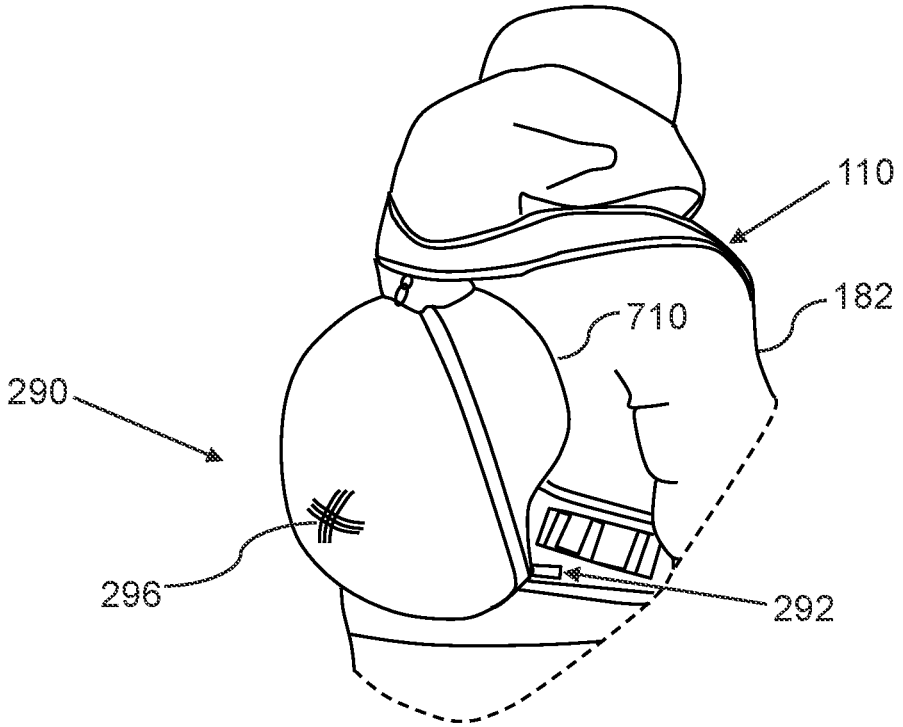
FIG. 7B is a rear perspective view of a helmet mounted in an unfolded helmet holding flexible bag, which is secured on a rear of the training harness of the training harness system, according to an embodiment of the invention.

In a related embodiment, as shown in FIGS. 2C, 7A and 7E, the training harness 110 can further include a pocket assembly 290, which can include:

a) a pocket body 292, which can include a pocket opening 793;

b) a zipper 294, which is configured to close and open the pocket opening; and c) a helmet bag 296, which is connected (in an inner portion of the helmet bag 296) to an interior of the pocket body 292. The helmet bag 296 can be made from an elastic material, such as an elastic mesh material;

such that the helmet bag 296 can be folded up and stored inside the pocket body 292, and such that the helmet bag 296 can be extracted from the pocket body 292 for containing and carrying a helmet 710, such that an outer portion of the helmet bag 296 is clipped to an upper portion.

In various related embodiments, as shown in FIG. 2A, the training harness 110 can further include various belt and strap tightening members, including:

a) a left adjustable belt strap 246, which connected in an inner end to an outer end of the left hip member 242 wherein an outer end of the left adjustable belt strap 246, is connected to a right belt clasp 247;

b) a right adjustable belt strap 248, which is connected in an inner end to an outer end of the right hip member 244, wherein an outer end of the right adjustable belt strap 248 is connected to a right belt clasp 249; such that the left and right belt clasps 247, 249 are detachably connected to tighten the left and right adjustable belt straps 246, 248 around a hip area of the student 182;

c) Left and right front adjustable straps 256, 258, which connect between respectively the left and right elongated shoulder members 232, 234 and respectively the left and right adjustable belt straps 246, 248; and d) An adjustable chest strap 226, which connects between outer portions of the left and right elongated shoulder members 232, 234.

In related embodiments, features and usability advantages of the training harness system 100 can include:

a) DEVELOPING CONFIDENCE: The biggest obstacle beginner students 182 face when learning to ski or snowboard isn't technique, it's FEAR. Knowing that a trainer 184 is right behind them making sure they're safe while practicing is the most important ingredient for progress;

b) CONTROLLING SPEED: juvenile students 182 can learn to make their way downhill at a safe pace. Flexible shock absorbing leashes 121 work to create a smooth ride;

c) SAFE CHAIRLIFT LOADING; Conveniently positioned handles 129 will allow a trainer 184 to have better control when students 182 fall, as well as when getting on the chairlift; and d) ADJUSTABLE SIZING: The harness vest 110 is designed to work for every child or toddler, with included multiple webbing loops 271, 272, 273, 274, 275, 276 for proper hip placement, as well as length extension to accommodate for different heights of students 182.

In related embodiments, a skiing process for use of the training harness system 100 can include:

a) Adjust harness on your juvenile student 182 based on their size/weight/height to identify all securing points;

b) When skiing, pull the rope to the left or right to help your juvenile student 182 initiate turns;

c) To help the juvenile student 182 on a flat surface simply position the straps to the front of the juvenile student 182 and pull them along;

d) Use the top handle for close range balance and/or if they fall; and e) As the juvenile student 182 skier begins to show progress and learns to go straight downhill, adjust the leash length and provide additional slack to give them more freedom to practice.

In a related embodiment, a method of use when using a chairlift can include:

a) Utilizing both or one of the upper and/or mid handles to help lift the juvenile student 182 up to his seat. Before going on the lift please disconnect all straps and place them in a provided poach. Simply clip the pouch to the multiple harness points or hold on to it. While riding the lift hold the juvenile student 182 from behind with either the mid or upper handle to keep them securely in; and b) Always fully disconnect the leash 121 from the harness 110 when going on/off the chairlift. Store the leash 121 in a provided mesh bag and clip the mesh bag to the harness.

Here has thus been described a multitude of embodiments of the training harness system 100, training harness 110, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A training harness system for snow sport training, comprising:

a) a training harness, which is configured to be worn by a student; and b) a leash assembly, comprising:

at least one leash, which is configured to be detachably connected to the training harness in a first end of the at least one leash, such that the at least one leash is configured to enable a trainer to hold on to a second end of the at least one leash;

wherein the at least one leash further comprises:

a first leash, which is configured to connect to a first side of a rear of the training harness, when the training harness is worn by the student; and a second leash, which is configured to connect to a second side of the rear of the training harness, when the training harness is worn by the student;

wherein the training harness further comprises a leash mounting assembly, which further comprises:

a left leash receiving assembly, which is configured to allow detachable connection of an inner end of the first leash;

a right leash receiving assembly, which is configured to allow detachable connection of an inner end of the second leash; and a central leash receiving structure, which is positioned between the left leash receiving assembly and the right leash receiving assembly, wherein the central leash receiving structure is configured to allow detachable connection of an inner end of the at least one leash;

wherein the left leash receiving assembly further comprises:

a left outer leash receiving structure, which comprises a left outer elongated aperture, which protrudes through a length of the left outer leash receiving structure;

a left center leash receiving structure, which comprises a left center elongated aperture, which protrudes through a length of the left center leash receiving structure; and a left inner leash receiving structure, which comprises a left inner elongated aperture, which protrudes through a length of the left inner leash receiving structure; and wherein the right leash receiving assembly further comprises:

a right outer leash receiving structure, which comprises a right outer elongated aperture, which protrudes through a length of the right outer leash receiving structure;

a right center leash receiving structure, which comprises a right center elongated aperture, which protrudes through a length of the right center leash receiving structure; and a right inner leash receiving structure, which comprises a right inner elongated aperture, which protrudes through a length of the right inner leash receiving structure;

whereby the training harness system enables the trainer to control and guide skiing or snowboarding of the student.

2. The training harness system of claim 1, wherein the training harness further comprises a harness body, comprising:

a) a back portion, which is configured to be positioned on a back of the student when the student is wearing the training harness;

b) a shoulder portion, which is configured to be positioned on a shoulder area of the student when the student is wearing the training harness, wherein the shoulder portion is above the back portion; and c) a folding portion, which is connected between the shoulder portion and the back portion;

wherein the harness body is configured to be length adjustable, such that the folding portion is configured to adjust accordingly.

3. The training harness system of claim 2, wherein the training harness further comprises:

a) a left adjustable shoulder strap, which is connected between the shoulder portion and the back portion; and b) a right adjustable shoulder strap, which is connected between the shoulder portion and the back portion, such that the right adjustable shoulder strap is mounted on a right side of the left adjustable shoulder strap; and such that adjustment of a left length of the left adjustable shoulder strap and adjustment of a right length of the right adjustable shoulder strap causes an adjustment of a corresponding length of the folding portion of the harness body, such that the folding portion is configured to adjust according to the corresponding length;

whereby a length of the harness body is adjustable to fit the student.

4. The training harness system of claim 1, wherein the training harness further comprises a harness body, comprising:

a) a back portion, which is configured to be positioned on a back of the student when the student is wearing the training harness;

b) a right hip member, which is configured to be positioned on a right hip area of the student when the student is wearing the training harness, such that an inner end of the right hip member is connected to a bottom right end of the back portion; and c) a left hip member, which is configured to be positioned on a left hip area of the student when the student is wearing the training harness, such that an inner end of the left hip member is connected to a bottom left end of the back portion.

5. The training harness system of claim 1, wherein the left leash receiving assembly and the right leash receiving assembly each further comprises:

at least one leash receiving structure, which comprises an elongated aperture, which protrudes through a length of the at least one leash receiving structure.

6. The training harness system of claim 1, wherein the training harness system is configured in a beginner configuration;

such that the inner end of the first leash is connected to the left outer leash receiving structure and the inner end of the second leash is connected to the right outer leash receiving structure.

7. The training harness system of claim 1, wherein the training harness system is configured in an intermediate configuration;

such that the inner end of the first leash is connected to the central leash receiving structure and the inner end of the second leash is connected to the right outer leash receiving structure.

8. The training harness system of claim 1, wherein the training harness system is configured in an advanced configuration;

such that an inner end of the at least one leash is connected to the central leash receiving structure.

9. The training harness system of claim 5, wherein each of the first leash and the second leash further comprises:

a) an elongated leash member;

b) a leash handle, which is connected to an outer end of the elongated leash member; and c) a leash connector, comprising:

a hook portion, which comprises:

an elongated hook member;

such that the elongated hook member is configured to detachably connect with the at least one leash receiving structure, such that the elongated hook member is inserted into the elongated aperture.

10. The training harness system of claim 9, wherein the leash connector, further comprises:

a circular portion, which is configured to attach to an inner end of the elongated leash member;

such that the hook portion is connected to an outer upper side of the circular portion.

11. The training harness system of claim 10, wherein a lower end of the elongated hook member comprises a notch, wherein the leash connector further comprises:

a clasp, such that an inner end of the clasp is rotatably connected to a lower end of the circular portion, such that an outer end of the clasp is configured to be closed in place on a lower end of the elongated hook member;

such that the notch is configured to hold the clasp in place in a closed position, such that the elongated hook member is securely connectable with the at least one leash receiving structure.

12. The training harness system of claim 10, wherein the hook portion is configured with an inverted u-shape, such that the hook portion comprises:

a) an inner portion, which is connected to the circular portion; and b) the elongated hook member, which is connected to the inner portion on an outer upper side of the inner portion.

13. The training harness system of claim 12, wherein the hook portion is rotatably connected to the circular portion, to allow a rotatable connection of the at least one leash to the training harness.

14. The training harness system of claim 12, wherein a lower end of the inner portion comprises a notch, wherein the leash connector further comprises:

a clasp, such that an inner end of the clasp is rotatably connected to a lower end of the elongated hook member, such that an outer end of the clasp is configured to be closed in place on a lower end of the inner portion;

such that the notch is configured to hold the clasp in place in a closed position, such that the elongated hook member is securely connected with the at least one leash receiving structure.

* * * * *